United States Patent [19]

Nace

[11] Patent Number: 4,551,951

[45] Date of Patent: Nov. 12, 1985

[54] DETACHABLE PORTABLE CONTINUOUS-BELT DRIVING HEAD

[75] Inventor: Robert J. Nace, Kingsville, Md.

[73] Assignee: Bethlehem Steel Corporation, Bethlehem, Pa.

[21] Appl. No.: 603,275

[22] Filed: Apr. 24, 1984

[51] Int. Cl.[4] ..... B24B 21/02; B24B 23/06

[52] U.S. Cl. ..... 51/170 EB

[58] Field of Search ..... 51/170 EB, 170 R, 135 R

[56] References Cited

U.S. PATENT DOCUMENTS 395,720 1/1889 Starr ..... 51/135 R 2,301,853 11/1942 Cannon ..... 51/170 EB 2,556,041 6/1951 Pick ..... 51/135 R 2,751,728 6/1956 Petit ..... 51/170 EB

FOREIGN PATENT DOCUMENTS 688690 2/1940 Fed. Rep. of Germany ... 51/170 EB

*Primary Examiner*—Roscoe V. Parker

*Attorney, Agent, or Firm*—John J. Selko

[57] ABSTRACT

A portable, hand-held, detachable, rotatable driving head for driving a continuous grinding belt by means of an air-driven, rotatable spindle including a detachable safety shield around the driving head.

4 Claims, 2 Drawing Figures

DETACHABLE PORTABLE CONTINUOUS-BELT DRIVING HEAD

BACKGROUND OF THE INVENTION

This invention relates to portable, hand-held grinders for reconditioning a curved surface of shafts and the like in place, without removing such shafts to a position adjacent a fixed grinding device.

In repairing large equipment in industrial settings, frequently, shafts and the like require a grinding operation on their surfaces. Portable hand-held grinders are difficult to accurately control and continuous belt grinders usually require complicated positioning devices for holding the belt against the surface to be ground. Such belt grinders are not portable and require removal of the shaft to a machine shop location.

There is a need therefore, for a portable continuous-belt grinding device which can be used in inconvenient locations, and physically at awkward orientation. The invention disclosed herein satisfies such need.

SUMMARY OF THE INVENTION

Disclosed herein is a detachable portable, rotatable driving head for driving a continuous grinding belt over a curved shaft surface, for grinding imperfections from such surface. The invention includes a cylindrical drive head concentrically threadably connected to a conventional air driven rotatable spindle. The drive head includes a first and second side guard with a rubber coated drum therebetween and a removable safety shield spanning about 180° of the periphery of the side guards. A continuous grinding belt, with abrasive on the inner surface, is driven by the drum.

DETAILED DESCRIPTION OF PREFERRED EMBODIMENT AND BEST MODE

Figures 1, 2:
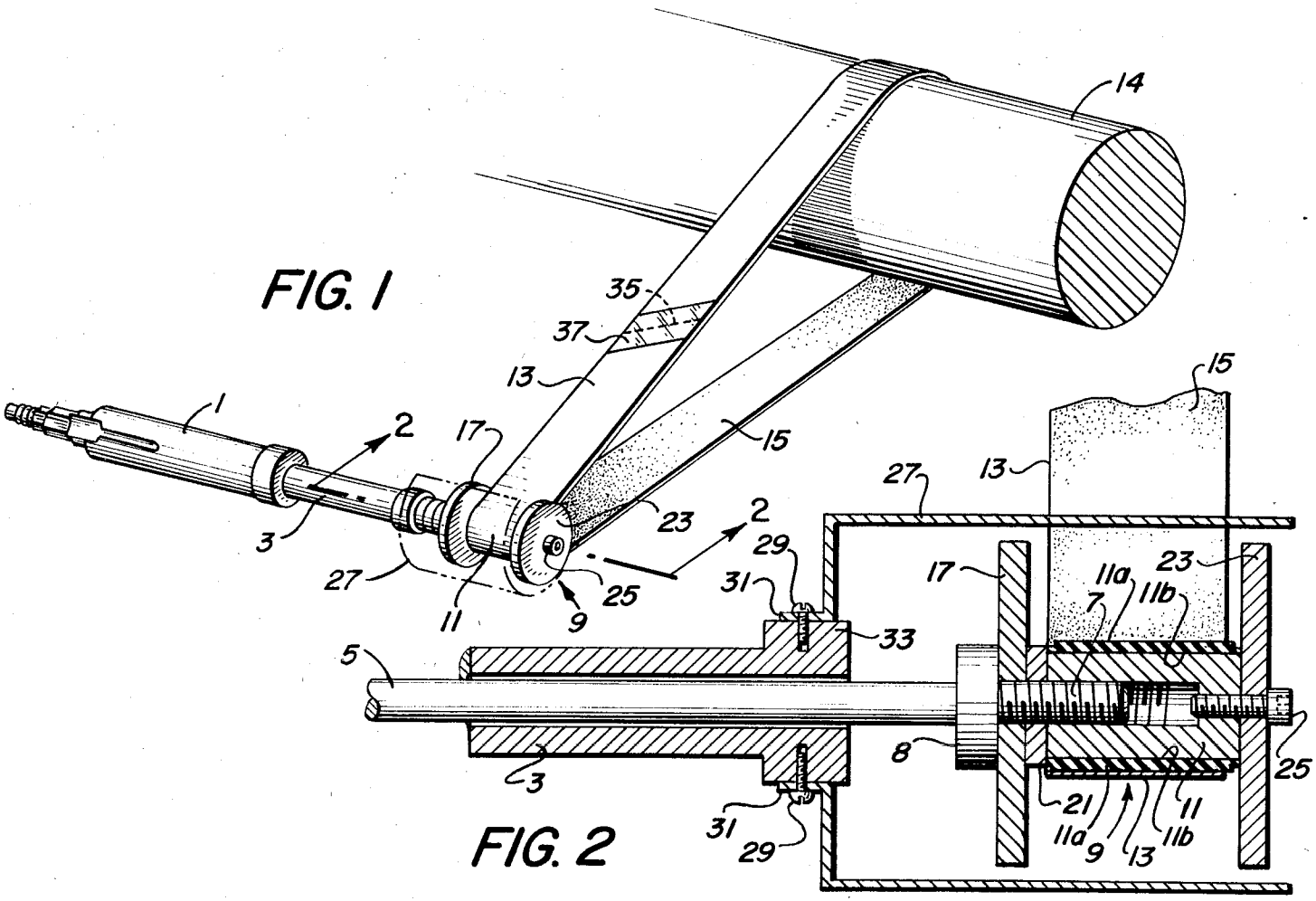
FIG. 1 is a perspective view showing the invention with a safety phantom.
FIG. 2 is a section along line 2—2 of FIG. 1

As shown in FIG. 1 and FIG. 2 air driven motor 1 includes a hollow tubular housing 3 extending therefrom. Within housing 3 is a rotatable cylindrical spindle 5 having a threaded end 7 thereon, and an upstanding flange portion 8 intermediate end 7 and motor 1, which flange 8 is generally concentric with the axis of spindle 5. The design of air motor 1, housing 3 and spindle 5 is conventional and not part of this invention. End 7 threadably engages removable drive head 9, to cause head 9 to rotate with spindle 5.

Drive head 9 includes a cylindrical drum 11 having an outer surface covered 11(*a*) with a rubber covering which is fluted 11(*b*) in an axial direction to provide good drive traction for driving endless belt 13 around shaft 14. Belt 13 has abrasive particles on the inner surface 15, and such inner surface 15 polishes shaft 14.

Drive head 9 includes a first cylindrical sideguard 17 spaced about spindle 5 generally concentrically with the axis of drum 11 and spindle 5, and held laterally in place by upstanding concentric cylindrical flange 8. Located between drum 11 and first side guard 17 is a spacer washer 21. Washer 21 provides space for lateral movement of belt 13, when belt 13 width is equal to rubber drum 11 length, thus avoiding binding of the belt as it moves.

A second cylindrical sideguard 23 is threadably mounted onto the other end of drum 11 in concentric relation therewith by means of cap screw 25. A safety shield 27 is removably affixed generally concentrically with the axis of drum 11 and spindle 5 by means of screws 29 extending through flanges 31 into upstanding stop 33 concentrically formed onto housing 3. Other conventional mounting means could be used. Shield 27 is formed from curved, generally cylindrical, metal portion which extends laterally from flanges 31 to over second sideguard 23. The end of shield opposite flanges 31 is generally open, in order to permit insertion of belt 31 as described hereinafter. Such shield spans about 180° of the periphery of circular sideguards 17 and 23 in spaced relation therewith to provide a space to insert and remove belt 13.

The length of belt 13 can be adjusted by taping together on diagonal line 33 with any suitable tape 37*a* length of suitable grinding belt.

In practice, I have successfully used an air motor Coleco Model #15GEL-90B supplied by Dresser Industries; a rubber drum from Chicago Rubber Company referred to as a Cosmos Slotted Plain Rubber Wheel; and an abrasive belt from Norton Abrasive Company which belt is referred to as NORZON (TM) cloth CLOSEKOTE (TM).

I claim:

1. A detachable portable rotatable driving head for driving a continuous grinding belt over a shaft surface comprising:

(a) a cylindrical rotatable drive head concentrically connected to a rotatable spindle, the drive head including:

(i) a cylindrical rubber-coated drum portion threadably connected to the spindle;

(ii) a first sideguard concentrically spaced about the spindle between one end of the drum and a stop flange on the spindle;

(iii) a washer between the drum and first side guard;

(iv) a second sideguard threadably fastened to another end of the drum; and (v) a continuous grinding belt carried on the drum and around the shaft.

2. The invention of claim 1 in which the drum includes axial flutes thereon to provide drive traction for the belt.

3. The invention of claim 1 further including a safety shield detachably mounted on a housing surrounding the spindle, the shield spaced from and spanning about 180° of the periphery of the first and second side guards.

4. The invention of claim 1 in which the grit is located on the inner surface of the grinding belt.

* * * * *